US005447794A

United States Patent [19]

Lin

[11] Patent Number: 5,447,794

[45] Date of Patent: Sep. 5, 1995

[54] POLYAMIDE SHEATH-CORE FILAMENTS WITH REDUCED STAINING BY ACID DYES AND TEXTILE ARTICLES MADE THEREFROM

[75] Inventor: Perry H. Lin, Seaford, Del.

[73] Assignee: E. I. du Pont de Nemours and Company, Wilmington, Del.

[21] Appl. No.: 301,502

[22] Filed: Sep. 7, 1994

[51] Int. Cl.[6] ..... D02G 3/00

[52] U.S. Cl. ..... 428/373; 428/374; 428/395; 528/170; 528/322; 528/330; 528/329.1; 528/338; 528/339

[58] Field of Search ..... 428/370, 373, 374, 395; 528/329.1, 330, 322, 338, 339, 170

[56] References Cited

U.S. PATENT DOCUMENTS

| | | | |
|---|---|---|---|
| 2,936,482 | 5/1960 | Kilian . | |
| 2,985,626 | 5/1961 | Caldwell et al. | 528/329.1 |
| 2,989,798 | 6/1961 | Bannerman . | |
| 3,645,819 | 2/1972 | Fujii et al. | 156/148 |
| 3,679,541 | 7/1972 | Davis et al. . | |
| 3,787,371 | 1/1974 | Brinkmann et al. | 528/329.1 |
| 4,075,378 | 2/1978 | Anton et al. | 428/373 |
| 4,521,484 | 6/1985 | Li | 428/374 |
| 4,592,940 | 6/1986 | Blyth et al. | 428/96 |
| 4,610,925 | 9/1986 | Bond | 428/373 |
| 4,956,236 | 9/1990 | Wang | 428/373 |
| 4,999,243 | 3/1991 | Maeda | 428/373 |
| 5,009,954 | 4/1991 | Collier et al. | 428/400 |
| 5,104,962 | 4/1992 | Yamaya et al. | 528/322 |
| 5,108,684 | 4/1992 | Anton et al. | 264/176.1 |
| 5,155,178 | 10/1992 | Windley | 525/432 |
| 5,242,733 | 9/1993 | Windley | 428/97 |
| 5,310,860 | 5/1994 | Maj et al. | 528/338 |

FOREIGN PATENT DOCUMENTS

| | | |
|---|---|---|
| 0398221 | 5/1990 | European Pat. Off. . |
| 0574772A1 | 3/1993 | European Pat. Off. . |

*Primary Examiner*—N. Edwards

[57] ABSTRACT

Sheath-core polyamide filaments are disclosed which are resistant to staining by coffee and acid dyes common in food and beverages. The sheath component is comprised of a partially aromatic or high carbon polyamide. The core component may be nylon 66, nylon 6 or copolymers thereof. Textile articles made from these sheath-core filaments are also disclosed.

7 Claims, 1 Drawing Sheet

POLYAMIDE SHEATH-CORE FILAMENTS WITH REDUCED STAINING BY ACID DYES AND TEXTILE ARTICLES MADE THEREFROM

FIELD OF THE INVENTION

This invention relates to polyamide sheath-core filaments wherein the sheath is comprised of a polyamide which is resistant to staining by acid dyes. This invention also relates to textile articles, especially carpets, made from these filaments.

BACKGROUND OF THE INVENTION

The two most common nylon fibers, nylon 6,6 and nylon 6, are not resistant to staining by certain acid dyes commonly present in foods and beverages. In the past, these nylon fibers have been made stain-resistant by either treating the fiber surface with an anti-stain chemical (see for example Blyth and Ucci U.S. Pat. No. 4,592,940) or by modifying the polymer (see for example Anton et al., U.S. Pat. No. 5,108,684 or Windley, U.S. Pat. No. 5,155,178). More recently Hoyt and Wilson, European Patent Application No. 574,772, have disclosed a bicomponent multilobal filament having a polyamide core and a hydrophobic polymer sheath. The sheath polymers disclosed include polyesters and polyolefins. Because polyesters and polyolefins are generally incompatible with nylon, sheath-core filaments of polyester-nylon or polyolefin-nylon may have poor mechanical properties and the sheath may separate from the core in some end uses. Therefore, an all-nylon sheath-core stain-resistant filament would be useful.

SUMMARY OF THE INVENTION

One embodiment of this invention is a sheath-core polyamide filament wherein the sheath component has a reduced tendency to stain with certain acid dyes commonly found in food and beverages. The core component is comprised of nylon 6,6; nylon 6 or copolymers thereof. The weight ratio of sheath component to core component is in the range of 10:90 to 80:20, preferably 10:90 to 50:50. The sheath component is comprised of a "high carbon nylon" (as hereinafter defined) or a "partially aromatic nylon" (as hereinafter defined). Suitable high carbon nylons include, but are not limited to, nylon 12,12; nylon 6,12; nylon 12; nylon 6,10; poly (1,4-bis(methylamino)cyclohexane sebacamide) (also referred to as nylon BAMC, 10 hereinafter); poly (1,4-bis(methylamino)cyclohexane dodecamide) (also referred to as nylon BAMC, 12 hereinafter); and nylon 11. Suitable partially aromatic polyamides include, but are not limited to, the random copolymer of hexamethylene diamine, isophthalic acid and terephthalic acid (also referred to as nylon 6I/6T hereinafter, 6I referring to the amide units formed by the reaction of hexamethylene diamine and isophthalic acid, and 6T referring to the amide units formed by the reaction of the diamine with terephthalic acid), and the random copolymer of hexamethylene diamine, 2-methylpentamethylene diamine and terephthalic acid (also referred to as nylon 6T/MPMD-T, hereinafter, MPMD-T referring to the amide units formed by the reaction of 2-methylpentamethylene diamine and terephthalic acid).

Another embodiment of this invention is textile articles such as, but not limited to, yarns, fabrics, and carpets made from the polyamide sheath-core filaments of this invention.

DETAILED DESCRIPTION OF THE INVENTION

Figure 1:
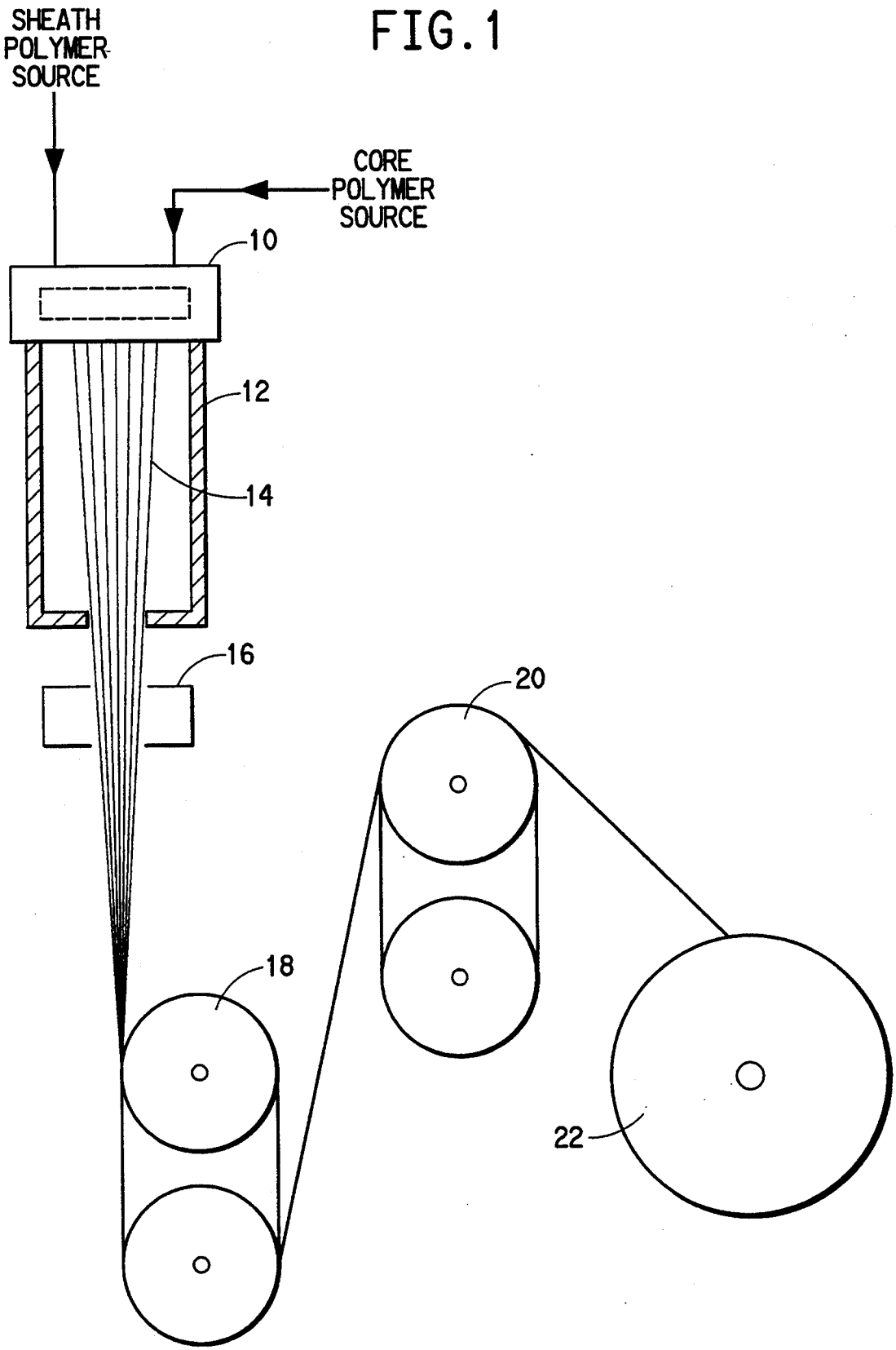
FIG. 1 is a schematic representation of a process suitable to make the sheath-core filaments of this invention.

The sheath-core bicomponent filaments of this invention may be melt spun by any of the conventional sheath-core spinning processes known in the art such as those described in U.S. Pat. Nos. 2,936,482 and 2,989,798, the disclosures of which are hereby incorporated by reference. The cross-sectional geometry of the resulting sheath-core filaments may be substantially concentric or it may be substantially eccentric as long as the amount of any core component exposed to the surface of the filament is not large enough to make the filament stain performance unacceptable.

A process suitable for making the sheath-core filaments of this invention is shown in FIG. 1. Polymer for forming the sheath component is pumped from a source (not shown) to a spinneret 10 suitable for forming sheath-core bicomponent filaments. Polymer for forming the core component is pumped from a second polymer source (not shown) to spinneret 10. The weight ratio of sheath component to core component in the filaments of this invention may be controlled by the rate at which the sheath polymer and core polymer is pumped to the spinneret.

The resulting sheath-core filaments 14 emerge from the spinneret 10 and pass through quench chimney 12 where a cooling gas is blown past the filaments. The filaments 14 are pulled from the spinneret 10 by means of a feed roll system 18. Prior to the feed rolls, spin finish is applied by applicator 16. From the feed rolls 18, filaments are passed over heated draw rolls 20. Following drawing, the filaments are wound onto a package 22. At a later time, filaments are textured in a bulker (not shown) such as the Model FYB-1 available from Hills Machine Company, Melbourne, Fla.

Although a split spin-draw followed by bulking process is described above, the skilled practitioner will immediately realize that a coupled spin-draw-bulking process could be used to make the filaments of this invention. Also, instead of continuous filaments, the sheath-core filaments of this invention could be made into staple by techniques well known in the art.

Nylon filaments for the purpose of carpet manufacturing have deniers in the range of 3 to 75 denier/filament (dpf), preferably 15 to 25 dpf.

The method of making carpets from the filaments of this invention is well known to those skilled in the art. Typically, two or more ends of BCF yarn are cable twisted together and the resulting yarn is heatset prior to tufting into a carpet.

The polyamide used in the core of the sheath-core filaments of this invention may be nylon 6,6 (poly(hexamethylene adipamide)), nylon 6 (poly(epsiloncaproamide)) or copolymers thereof.

Polyamides suitable for use as the sheath component in this invention include high carbon nylons and partially aromatic nylons. By "high carbon nylon" is meant nylon made from a diacid and a diamine wherein at least one of the latter moieties contains between 8–22 carbon atoms. "High carbon nylon" also refers to nylon made from a lactam or amino acid containing 8–22 carbon atoms. Examples of high carbon nylons include, but are not limited to, nylon 12,12; nylon 6,12; nylon 12, nylon 6,10; nylon 11; poly(1,4-bis(methylamino)cyclohexane sebacamide), also called nylon BAMC, 10; and poly(1,4-bis(methylamino)cyclohexane dodecamide), also called nylon BAMC, 12.

By "partially aromatic nylon" is meant nylon made from either an aromatic diacid and an aliphatic diamine, or nylon made from an aliphatic diacid and an aromatic diamine. Examples of partially aromatic nylons include, but are not limited to, nylon 6I/6T (the random copolymer of hexamethylene diamine, isophthalic acid and terephthalatic) and nylon 6T/MPMD-T (the random copolymer of hexamethylene diamine, 2-methylpentamethylene diamine and terephthalic acid. In nylon 6I/6T, the weight ratio of 6I units to 6T units is in the range of 30:70 to 90:10, preferably about 70:30. In the nylon 6T/MPMD-T, the weight ratio of 6T units to MPMD-T units is in the range of 20:80 to 80:20, preferably about 50:50.

Common polymer additives such as, but not limited to, pigments, stabilizers, flame retardants, delusterants, antimicrobial agents, etc. may be incorporated into the sheath polymer, core polymer or both polymers prior to extruding into filaments.

TEST METHODS

Relative Viscosity (RV) is the formic acid relative viscosity measured as described at col. 2, lines 42–51, in Jennings, U.S. Pat. No. 4,702,875.

Amine Ends are determined by the methods described on pages 293 and 294 in Volume 17 of the "Encyclopedia of Industrial Chemical Analysis" published by John Wiley & Sons (1973).

Acid Staining of Yarns

A staining agent, cherry-flavored sugar-sweetened KOOL-AID (sold commercially), is prepared by mixing 45 g (±1) of KOOL-AID in 500 cc of water, and allowing it to reach room temperature, i.e., 75°±5° F. or 24°±3° C. before using.

The yarn skein sample is placed on a flat, non-absorbent surface; 20 ml of KOOL-AID are poured onto the yarn skein specimen from a height of 12 inches (30 cm) above the yarn skein surface, and the specimen is then left undisturbed for a period of 24 hours. To confine the stain, a cylinder approximately two inches (5 cm) in diameter may be placed on the yarn skein and the stain may be poured through it.

Excess stain is blotted with a clean white cloth or clean white paper towel or scooped up as much as possible, without scrubbing. Blotting is always performed from the outer edge of spill in towards the middle to keep the spill from spreading. Cold water is applied with a clean white cloth or a sponge over the stained area, gently rubbing against the pile from left to right and then reversing the direction from right to left. The excess is blotted.

A detergent cleaning solution (15 g (±1) of TIDE detergent mixed in 1000 cc of water, and also allowed to reach room temperature before using), is applied with a clean white cloth or a sponge directly to the spot, gently rubbing the pile from left to right and then reversing the direction from right to left. The entire stain is treated, all the way to the bottom of the pile, and then the blotting is repeated.

The cold water treatment is repeated, and the yarn skein is blotted thoroughly, to remove the stain and also the cleaning solution, so the yarn skein does not feel sticky or soapy.

The cold water and detergent cleaning steps are repeated until the stain is no longer visible, or no further progress can be achieved. The carpet is blotted completely to absorb all the moisture.

The stain-resistance of the yarn skein is visually determined by the amount of color left in the stained area of the yarn skein after this cleaning treatment. This is referred to as the stain-rating, and can be categorized according to the following standards:

5—no staining
4—slight staining
3—noticeable staining
2—considerable staining
1—heavy staining In other words, a stain-rating of 5 is excellent, showing excellent stain-resistance, whereas 1 is a poor rating, showing heavy staining.

Acid Staining of Polymer Pellets

The ability of a sheath polymer candidate to resist staining by acid dyes can be predicted by performing a stain test on pellets of the candidate polymer. The staining procedure is the same as that described for yarns in the preceding test method except that polymer pellets are used instead of yarn skeins. Rather than using the visual, 1–5, rating scale, the degree of staining is measured using Applied Color Systems (ACS) 1800 Model 50 Color Control System.

Coffee Staining Test

Instant coffee powder (25 g) is dissolved in 500 g of water. The solution is then heated to 80°±2° C. A yarn skein sample is then totally immersed in the hot coffee solution. The solution is allowed to cool to room temperature and, after 24 hours, the yarn skein sample is removed from the solution and rinsed in cold water. The coffee stain rating is visually determined using the scale.

5—no staining
4—slight staining
3—noticeable staining
2—considerable staining
1—heavy staining

EXAMPLES

Example 1

The ability of six potential sheath polyamides to resist acid staining was determined according to the "Acid Staining of Polymer Pellets" Test Method described above. As a comparison, controls of nylon 66 homopolymer and a polymer known to be stain-resistant, nylon 66 randomly copolymerized with 3 weight percent of the sodium salt of 5-sulfoisophthalic (SIA) were subjected to the stain test. The results are in Table I.

TABLE I

| Polymer | dE* | da* |
|---|---|---|
| nylon 66 (control) | 58.81 | 42.90 |
| 3% SIA nylon 66 copolymer (control) | 36.23 | 27.21 |
| nylon 6, 12 | 16.80 | 12.11 |
| nylon 12, 12 | 13.14 | 4.31 |
| nylon 6I/6T (70:30 weight ratio) | 13.92 | 2.64 |
| nylon BAMC, 10 | 7.49 | 1.21 |
| 6T/MPMD-T (50:50 weight ratio) | 16.54 | 0.90 |

The values dE* and da* measured on the ACS color system indicate total color shift on staining and color shift toward red on staining, respectively. Therefore, the lower the dE* and da*, the less the polymer was stained by the acid dye.

As seen in Table I, all of the potential sheath polymers perform better than both the nylon 66 control and the 3% SIA nylon 66 random copolymer control.

Example 2

This Example demonstrates the stain-resistance of nylon filaments having nylon 6,12 sheath polymer and nylon 66 core polymer.

Nylon 6,12 (available from DuPont as Engineering Resin FE3643 having a number average molecular weight of approxiamtely 31,000 was melted and fed to a spinning machine at a rate of 4 grams per minute to form the sheath of a sheath-core filament. Nylon 66 polymer, having an RV of about 41 and amine ends of about 50 gram equivalents per million grams of polymer, was fed to the spinning machine at a rate of 36 grams per minute. Both polymers were kept at about 290° C.

Sheath-core filaments were spun using the technique shown in U.S. Pat. Nos. 2,936,482 and 2,989,798. A spinneret with 34 capillaries was used to produce filaments having a round cross-section. The extruded filaments passed through a 60 inch quench chamber where they were cross-flow quenched with air. The feed roll speed was 407 meters per minute and the draw roll speed was 800 meters per minute. Draw roll temperature was 125° C. The resulting yarn was about 520 denier. The sheath to core weight ratio was 1:9.

Two ends of 520 denier yarn were combined and then textured on a bulker manufactured by Hills Machine Company of Melbourne, Fla. (Model number FYB-1) to make bulked continuous filament yarn having a denier of about 1200. The bulker's feed roll was maintained at 80° C. and its speed was 200 yards per minute. The bulking air temperature was 200° C. and the air pressure was 70 psi.

The results of the staining test are shown in Table II.

Example 3

The effect of the weight ratio of sheath component to core component on stain-resistance was investigated by varying the weight ratios in this Example and in Example 4.

For this Example, the sheath and core polymers and spinning and bulking conditions were the same as in Example 2 except that the feed rate of sheath polymer was 8 grams per minute and the feed rate of core polymer was 32 grams per minute. Therefore, the sheath to core weight ratio was 1:4.

The results of the staining tests are shown in Table II.

Example 4

The sheath and core polymers, spinning and bulking conditions were the same as in Example 2 except that the feed rate of the sheath polymer was 12 grams per minute and the feed rate of core polymer was 28 grams per minute. The sheath to core weight ratio was 3:7.

Staining test results are shown in Table II.

Comparative Examples

Two single component comparative yarns were made made using 100% core polymer. Comparative Example 1 was of nylon 66 polymer. Comparative Example 2 was of a random copolymer of nylon 66 copolymerized with 3 weight percent of the sodium salt of 5-sulfoisophthalic acid (SIA). Spinning and bulking conditions were the same as those used in Example 2 except that the feed rate of the sheath polymer was 0 grams per minute and the feed rate of the core polymer was 40 grams per minute. The feed roll speed was set to 300 meters per minute.

The results of the staining tests are shown in Table II.

TABLE II

| Example | Sheath to Core Weight Ratio | Acid Dye Stain Rating | Coffee Stain Rating |
|---|---|---|---|
| Comparative 1 | — | <<1 | 1 |
| Comparative 2 | — | 2 | 1 |
| Example 2 | 1:9 | 2.5 | 3 |
| Example 3 | 1:4 | 2.5 | 3–4 |
| Example 4 | 3:7 | 2.5 | 3–4 |

As predicted from the polymer pellet test in Example 1, all the sheath core yarns had better stain resistance than that of a single component nylon 66 yarn. Acid dye stain-resistance of the sheath core fibers was at least as good as that of the known stain-resistant yarn of comparative Example 2. Coffee stain resistance of the sheath-core yarns was significantly better than that of either control. Coffee stain resistance was improved by increasing the weight ratio of sheath to core component.

Example 5

Examples 5–7 illustrate the use of the partially aromatic nylon, nylon 6I/6T as the sheath component. The nylon 6I/6T used for these examples was the random copolymer of hexamethylene diamine isophthalate and hexamethylene diamine terephthalate in a weight ratio of 70:30.

Spinning and bulking conditions were the same as in Example 2 except that nylon 6I/6T was used as the sheath component and the feed roll speed was 420 meters per minute.

The stain results are shown in Table III.

Example 6 spinning and bulking conditions were the same as in Example 3 except that nylon 6I/6T was used as the sheath component and the feed roll speed was 420 meters per minute.

The stain results are shown in Table III.

Example 7

Spinning and bulking conditions were the same as in Example 4 except that the feed roll speed was 420 meters per minute.

The stain results are shown in Table III.

TABLE III

| Example | Sheath to Core Weight Ratio | Acid Dye Stain Rating | Coffee Stain Rating |
|---|---|---|---|
| Comparative 1 | — | <<1 | 1 |
| Comparative 2 | — | 2 | 1 |
| Example 5 | 1:9 | 3.5 | 3 |
| Example 6 | 1:4 | 4.5 | 3 |
| Example 7 | 3:7 | 5.0 | 3–4 |

Once again the sheath-core bicomponent yarns outperformed the single component nylon 66 yarn (comparative example 1). Acid dye and coffee stain-resistance of the sheath-core yarns were significantly better than that of the known stain resistant yarn of comparative Example 2. The greater the weight ratio of sheath to core component, the better the stain performance.

I claim:

1. A polyamide sheath-core filament comprising: a core component of a first polyamide, said first polyamide being selected from the group consisting of nylon 66, nylon 6 and copolymers thereof; and a sheath component of a second polyamide, said second polyamide being selected from the group consisting of poly(1,4-bis(methylamino)cyclohexane sebacamide), poly(1,4-bis(methylamino)cyclohexane dodecamide) and a partially aromatic nylon, and wherein said filament has a sheath component to core component weight ratio between 10:90 to 80:20.

2. A filament of claim 1, wherein the sheath component to core component weight ratio is 10:90 to 50:50.

3. A filament of claim 2, wherein said partially aromatic nylon is selected from the group consisting of the random copolymer of hexamethylene diamine, isophtalic acid and terephthalic acid; and the random copolymer of hexamethylene diamine, 2-methyl pentamethylene diamine and terephthalic acid.

4. A filament of claim 3, wherein the partially aromatic nylon is the random copolymer of hexamethylene diamine, isophthalic acid and terephthalic acid and wherein said partially aromatic nylon has a weight ratio of hexamethylene isophthalamide units to hexamethylene terephthalamide units between 30:70 to 90:10.

5. A filament of claim 4, wherein the weight ratio of hexamethylene isophthalamide units to hexamethylene terephthalamide units is 70:30.

6. A filament of claim 3, wherein the partially aromatic nylon is the random copolymer of hexamethylene diamine, 2-methyl pentamethylene diamine and terephthalic acid and wherein said partially aromatic nylon has a weight ratio of hexamethylene terephthalamide units to 2-methyl pentamethylene terephthalamide units between 20:80 to 80:20.

7. A filament of claim 6, wherein the ratio of hexamethylene terephthalamide units to 2-methyl pentamethylene terephthalamide units is 50:50.

* * * * *